US005787052A

United States Patent [19]

Gardner et al.

[11] Patent Number: 5,787,052

[45] Date of Patent: Jul. 28, 1998

[54] SNAP ACTION ROTARY PULSER

[75] Inventors: Wallace Reid Gardner; Wilson Chung-Ling Chin, both of Houston, Tex.

[73] Assignee: Halliburton Energy Services Inc., Houston, Tex.

[21] Appl. No.: 483,739

[22] Filed: Jun. 7, 1995

[51] Int. Cl.[6] ..... G01V 1/40; H04M 9/00

[52] U.S. Cl. ..... 367/84; 367/148; 446/206; 175/48

[58] Field of Search ..... 367/84, 148; 181/106, 181/142; 446/204–206; 116/147; 175/48, 50

[56] References Cited

U.S. PATENT DOCUMENTS

| | | | |
|---|---|---|---|
| 3,764,968 | 10/1973 | Anderson | 367/84 |
| 3,764,969 | 10/1973 | Cafferly | 367/84 |
| 4,007,805 | 2/1977 | Reber | 181/120 |
| 4,734,892 | 3/1988 | Kotlyar | 367/83 |
| 4,785,300 | 11/1988 | Chin | 340/861 |
| 4,847,815 | 7/1989 | Malone | 367/84 |
| 4,914,637 | 4/1990 | Goodsman | 367/83 |
| 5,073,877 | 12/1991 | Jeter | 367/84 |
| 5,119,344 | 6/1992 | Innes | 367/84 |
| 5,182,731 | 1/1993 | Hoelscher | 367/84 |
| 5,189,645 | 2/1993 | Innes | 367/84 |
| 5,357,483 | 10/1994 | Innes | 367/84 |

OTHER PUBLICATIONS

Attang et al, SPE, IADC, Drilling Conf. Feb. 23, 1993, Proc. pp. 149–159; abst. only herewith.

*Primary Examiner*—Nelson Moskowitz
*Attorney, Agent, or Firm*—Conley, Rose & Tayon, P.C.

[57] ABSTRACT

A pressure pulse generator, or "pulser," and methods for operation are described. The pulser is constructed of a stator and rotor mounted within a housing, each being configured with a central hub and one or more radially extending lobes. An equal number of ports are spaced between the lobes. The lobes of the rotor are cross-sectionally tapered in the streamwise direction. The rotor and stator are maintained within the housing in a coaxial spaced relation from each other. The axial distance between the rotor and stator may be selectively varied by a linear actuator. In a preferred embodiment, the linear actuator comprises a conventional solenoid assembly which is operably associated with the rotor to move it axially within the housing with respect to the stator between a first position, wherein the distance between the rotor and stator is reduced, and a second position, wherein the distance between the rotor and stator is increased. The linear actuator is energized in response to signals from an encoder. Movement of the rotor to its first position causes the pulser to move into a stable closed condition wherein the ports of the stator are blocked by the lobes of the rotor. Movement of the rotor to its second position causes the pulser to be moved into a stable open position wherein the ports of the stator are not blocked by the rotor's lobes. The opening and closing occurs with a snap action between its stable open and stable closed positions, causing discrete pulses to be generated within the mud column. The pulser assembly is capable of generating different types of telemetry signals including non-return to zero

11 Claims, 4 Drawing Sheets

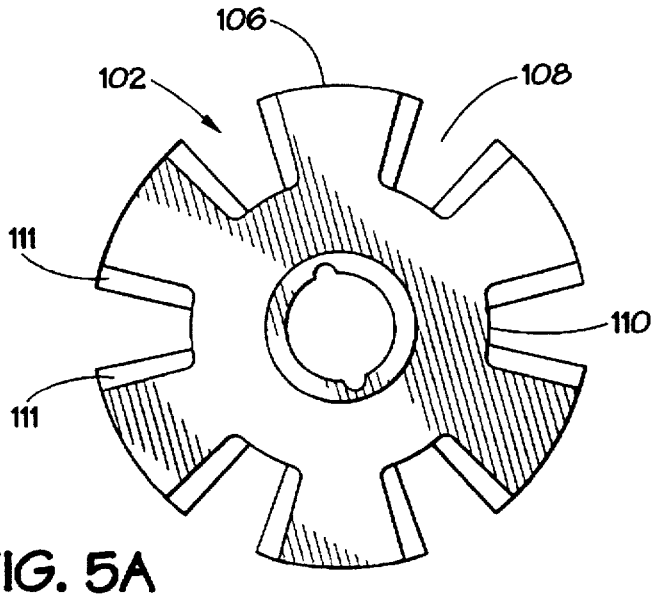
FIG. 5A
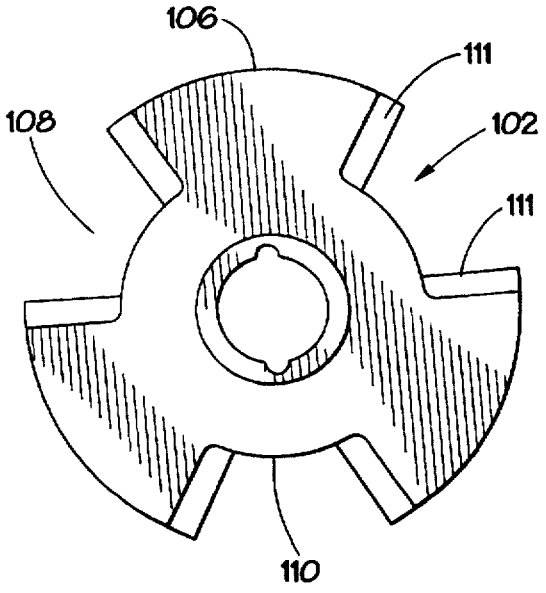
FIG. 5B
FIG. 5C
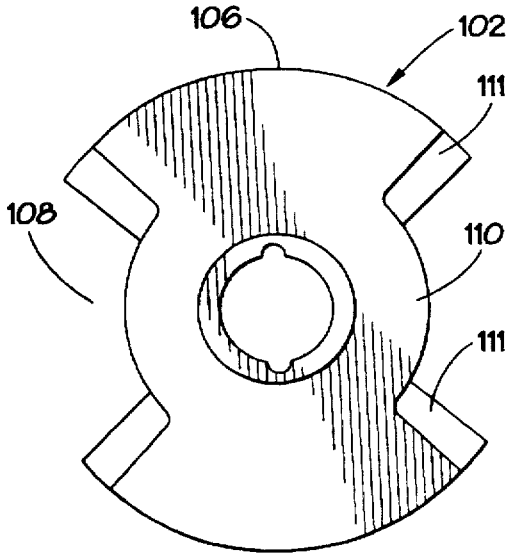

SNAP ACTION ROTARY PULSER

BACKGROUND OF THE INVENTION

1. Field of the Invention

The present invention relates generally to a telemetry system for transmitting data from within a wellbore to the surface during operation. More particularly, the present invention relates to a snap-action pulser for use in a measurement-while-drilling ("MWD") system or other system through the medium of the fluid.

2. Description of the Related Art

A popular technique for obtaining at the surface the data taken at the bottom of a borehole is the use of a measurement-while-drilling ("MWD") telemetry system. In systems of this nature, sensors or transducers positioned at the lower end of the drill string continuously or intermittently monitor predetermined drilling parameters and the appropriate information is transmitted to a surface detector while drilling is in progress. The information is digitally encoded for transmission by an encoder. A number of different MWD transmission systems are known which relay the information to the surface through the column of mud which extends from the bottom of the borehole to the surface during drilling.

A common apparatus used for transmission is the "siren" which is mounted inside a wellbore and generates a continuous, "passband" signal to carry the encoded information. The "passband" signal is centered around a "carrier" frequency which is equal to the siren's rotary speed times the number of rotor lobes. Sirens typically feature a stationary stator and a coaxially mounted rotor which is rotatable with respect to the stator. Both the stator and rotor are configured with radially extending lobes which are spaced apart by an equal number of ports. As the rotor is rotated by a motor, the ports of the stator are alternately opened by the rotor's lobes and closed to permit flow of mud past the siren. The opening and closing of the ports generates a relatively continuous series of pressure signals within the mud column. The number of pulses per revolution of the rotor will be defined by the number of radial lobes on the rotor and stator. For example, a siren wherein the rotor and stator each has six lobes (and six ports) would produce six pulses per revolution of the rotor. An example of a siren of this type is that described in U.S. Pat. No. 4,785,300 issued to Chin et al. The signals created by sirens of this type are alternating or cyclical signals at a designated frequency which will have a determinable phase relationship in relation to some other alternating signal, such as a selected reference signal generated in the circuitry of the signal detector at the surface. Known signal modulation techniques such as frequency shift keying (FSK) and phase shift keying (PSK) are used to encode the information within the signal. In devices of this type, the acoustic signal serves as a carrier wave for the encoded data. FSK and PS are known as passband signals whose energies are concentrated around a carrier frequency equal to the rotor speed times the number of lobes.

Pulsers are also known which transmit downhole information in the form of an unmodulated sequence of pulses whose energy is concentrated in the frequency and extending from Ø to $F_c$ Hz, where $F_c$ is the cutoff frequency. These step-like signals are known as baseband, rather than passband, signals. One type of pulser uses a poppet valve which opens and closes a central opening by an axially moveable plug. In general, poppet devices function like one-way check valves; they are opened and closed by an actuator to selectively permit the passage of mud past the poppet valve. Unfortunately, this type of operation is cumbersome and wasteful of energy because the actuator must act against the natural movement of the mud during Devices of this nature are used in MWD systems presently by a number of companies including Teleco, a subsidiary of Baker-Hughes Inteq, Houston, Texas and Sperry-Sun, a subsidiary of Dresser Industries, Houston, Texas.

A second type of pulser is a rotary pulser. The rotary pulser includes a bladed or vaned rotatable rotor and a stationary bladed or vaned stator which is coaxially mounted with the rotor. Rotation of the rotor with respect to the stator produces a signal in a manner similar to the siren. But rather than being driven by a fluid flow so as to produce a relatively continuous series of passband signals, rotation of the rotor is controlled to selectively restrict the flow of mud and thus produce a desired sequence of baseband signals, or pulses within the mud column. Actuation of these rotary pulsers is typically accomplished by means of a torsional force applicator which rotates the rotor a short angular distance to either open or close the pulser. Examples of rotary pulsers are those described in U.S. Pat. Nos. 4,914,637 issued to Goodsman, and 5,119,344, issued to Innes. A latching means is often used to control movement of the rotor and cause selective stepwise incremental movement of the rotor so that flow restriction occurs selectively.

SUMMARY OF THE INVENTION

The present invention features a rotary-type pulser which is constructed of a stator and rotor mounted within a housing.

The downstream rotor and upstream stator are maintained coaxially within the housing in a spaced relation from each other. The axial distance between the rotor and stator may be selectively varied by a linear actuator. The stator and rotor are each configured with a central and one or more lobes radially extending therefrom. An equal number of ports are spaced between the lobes. The lobes of the downstream rotor are tapered in such a manner that their cross-sectional area increases in the downstream direction. The downstream faces of the stator lobes will preferably be dimensionally larger than the upstream faces of the rotor lobes. In a preferred embodiment, the linear actuator comprises a conventional solenoid assembly which is operably associated with the rotor to move the rotor axially within the housing with respect to the stator. The linear actuator is energized in response to signals from an encoder. The rotor is moveable between a first position, wherein the axial distance between the rotor and stator is reduced, and a second position, wherein the distance between the rotor and stator is increased.

As a result of hydraulic effects created by the flow of mud past the pulser, movement of the rotor to its first position causes the pulser to be moved into a stable closed condition wherein the rotor is rotated with respect to the stator so that the ports of the stator are blocked by the lobes of the rotor. Conversely, movement of the rotor to its second position causes the pulser to be moved into a stable open position wherein the ports of the stator are not blocked by the rotor's lobes. Timewise movement of the pulser between its stable open and stable closed positions is associated with time-dependent pressure pulse changes within the mud column. The manner in which this snap action rotary pulser "snaps" open or closed is controlled by hydraulic forces acting on the rotor, which, in turn, are dictated by the amount of taper used. The pulser is thus capable of generating different types of telemetry signals such as non-return to zero (NRZ), FSK and PSK signals.

Because it does not require a latching means to control rotation of the rotor, the pulser of the present invention is simple in construction as compared to known rotary pulsers. In the pulser draws only upon the hydraulic forces caused by the flow within the flowbore to assist operation. This arrangement therefore often requires less energy to operate than either poppet valves or known rotary pulser designs and is generally efficient and reliable in operation.

BRIEF DESCRIPTION OF THE DRAWINGS

For a more detailed description of the preferred embodiment of the present invention, reference will now be made to the accompanying drawings, wherein:

FIGS. 5A–5C depict various exemplary configurations for rotors.

DESCRIPTION OF THE PREFERRED EMBODIMENT

During the course of the following description, the terms "upstream" and "downstream" are used to denote the relative position of certain components with respect to the direction of the flow of drilling mud. Thus, where a term is described as upstream from another, it is intended to mean that drilling mud flows first through the first component before flowing through the second component. Similarly, the terms such as "above," "upper," and "below" are used to identify the relative position of components in the wellbore, with respect to the distance to the surface of the wellbore as measured along the wellbore path.

Figure 1:
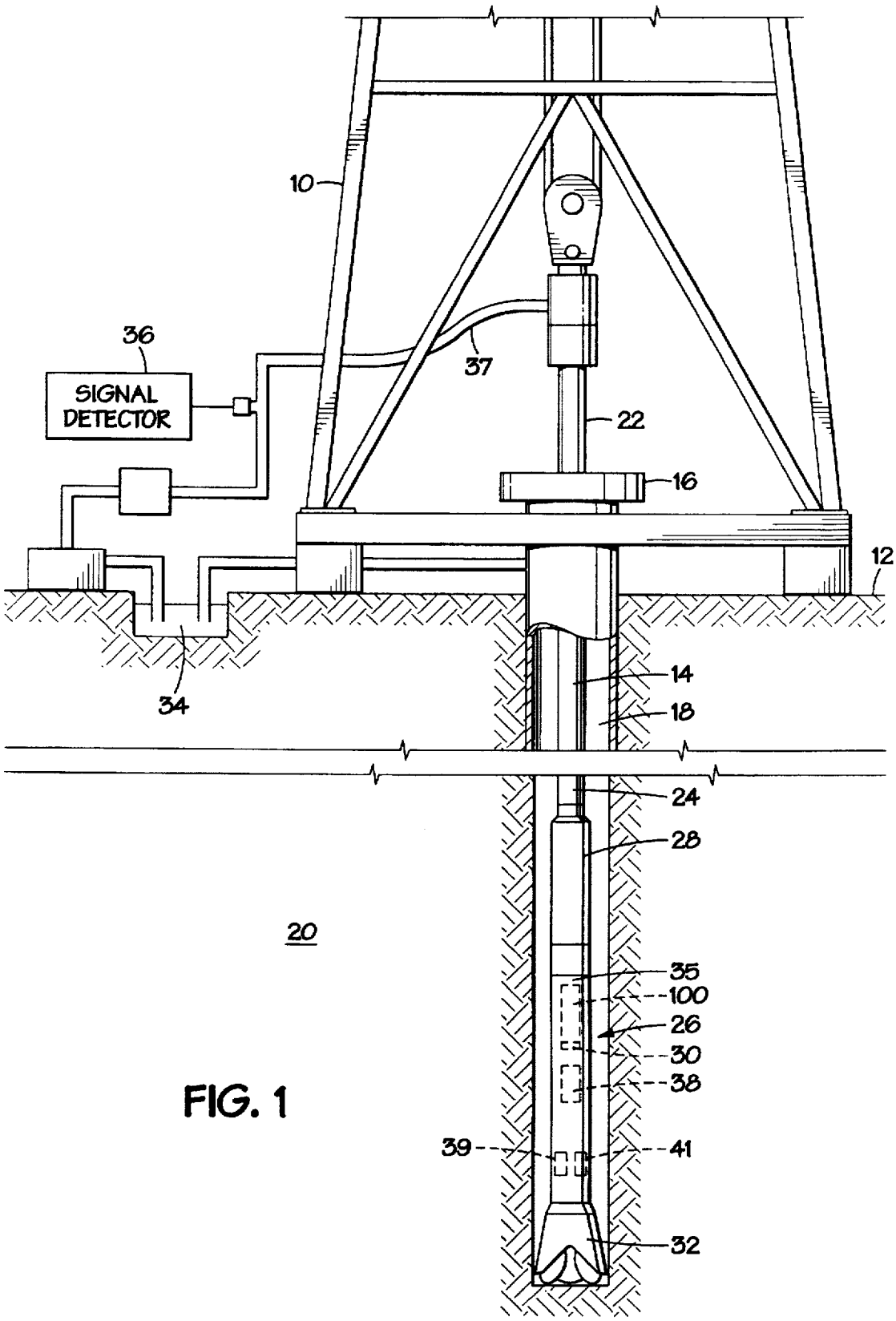
FIG. 1 is a schematic view of a drilling assembly implementing a snap action rotary pulser assembly as part of a MWD system in accordance with the present invention.

Referring now to FIG. 1, a typical drilling installation is illustrated which includes a drilling in 10, constructed at the surface 12 of the well, supporting a drill string 14. The drill string 14 penetrates through a rotary table 16 and into a borehole 18 that is being drilled through earth formations 20. The drill string 14 includes a kelly 22 at its upper end, drill pipe 24 coupled to the kelly 22, and a bottom hole assembly 26 (commonly referred to as a "BHA") coupled to the lower end of the drill pipe 24. The BHA 26 typically includes drill collars 28, a MWD tool 30, and a drill bit 32 for penetrating through earth formations to create the borehole 18. In operation, the kelly 22, the drill pipe 24 and the BHA 26 are rotated by the rotary table 16. Alternatively, or in addition to the rotation of the drill pipe 24 by the rotary table 16, the BHA 26 may also be rotated, as will be understood by one skilled in the art, by a downhole motor. The drill collars are used, in accordance with conventional techniques, to add weight to the drill bit 32 and to stiffen the BHA 26, thereby enabling the BHA 26 to transmit weight to the drill bit 32 without buckling. The weight applied through the drill collars to the bit 32 permits the drill bit to crush and make cuttings in the underground formations.

As shown in FIG. 1, the BHA 26 preferably includes an MWD tool 30, which may be considered part of the drill collar section 28. As the drill bit 32 operates, substantial quantities of drilling fluid (commonly referred to as "drilling mud") are pumped from a mud pit 34 at the surface through the kelly hose 37, into the drill pipe, to the drill bit 32. The drilling mud is discharged from the drill bit 32 and functions to cool and lubricate the drill bit, and to carry away earth cuttings made by the bit. After flowing through the drill bit 32, the drilling fluid rises back to the surface through the annular area between the drill pipe 24 and the borehole 18, where it is collected and returned to the mud pit 34 for filtering. The circulating column of drilling mud flowing through the drill string also functions as a medium for transmitting pressure pulse acoustic wave signals, carrying information from the MWD tool 30 to the surface.

Typically, a downhole data signalling unit 35 is provided as part of the MWD tool 30 which includes transducers mounted on the tool that take the form of one or more condition responsive sensors 39 and 41, which are coupled to appropriate data encoding circuitry, such as an encoder 38, which sequentially produces encoded digital data electrical signals representative of the measurements obtained by sensors 39 and 41. While two sensors are shown, one skilled in the art will understand that a smaller or larger number of sensors may be used without departing from the principles of the present invention. The sensors are selected and adapted as required for the particular drilling operation, to measure such downhole parameters as the downhole pressure, the temperature, the resistivity or conductivity of the drilling mud or earth formations, and the density and porosity of the earth formations, as well as to measure various other downhole conditions according to known techniques. See generally "State of the Art in MWD," International MWD Society (Jan. 19, 1993).

The MWD tool 30 preferably is located as close to the bit 32 as practical. Signals representing measurements of borehole dimensions and drilling parameters are generated and stored in the MWD tool 30. In addition, some or all of the signals are transmitted in the form of pressure pulses, as will be described, upward through the drill string 14. A pressure pulse travelling in the column of drilling mud can be detected at the surface by a signal detector unit 36, according to conventional techniques.

In accordance with the preferred embodiment of this invention, the data signalling unit 35 includes a snap action rotary pulser assembly 100 to selectively interrupt or obstruct the flow of drilling mud through the drill string 14, and thereby produce pressure pulses. The pulser 100 is selectively operated in response to the data encoded electrical output of the encoder 38 to generate a corresponding series of pulsed acoustic signals. These acoustic signals are transmitted to the well surface through the medium of the drilling mud flowing in the drill string. This medium if drilling mud is flowed is commonly referred to as a mud column. The acoustic signals preferably are encoded binary representations of measurement data indicative of the downhole drilling parameters and formation characteristics measured by sensors 39 and 41. When these pressure pulse signals are received at the surface, they are detected, decoded and converted into meaningful data by the signal detector 36.

Figure 2:
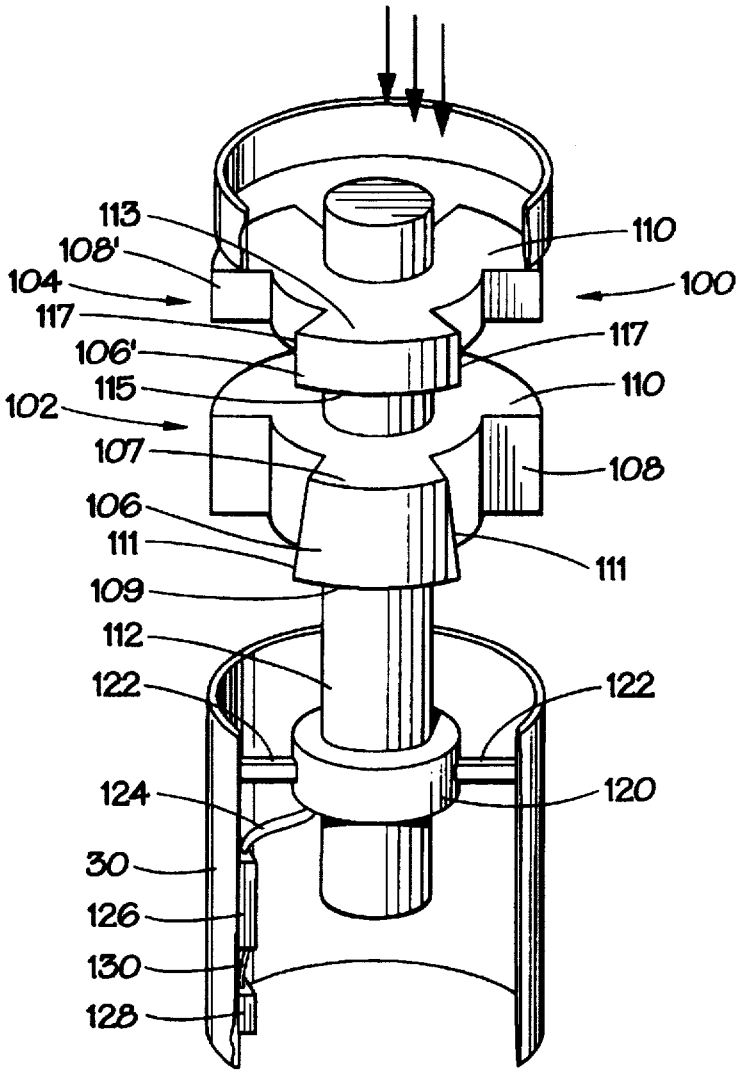
FIG. 2 is an isometric view of an exemplary snap action rotary pulser constructed in accordance with the preferred embodiment.

Referring now to FIGS. 2, as well as 3A–3B and 4A–4B, the pulser 100 comprises a fixed upstream stator 104 and a rotatable downstream rotor 102. For purposes of description and as shown in FIGS. 1, 2 and 3A–3B, the pulser 100 preferably mounts within the MWD drill collar 30 of the bottomhole assembly ("BHA") according to conventional techniques. The rotor 102 and stator 104 include at least one lobe 106 (identified as 106' in the stator) and at one port 108 (identified as 108' in the stator) around a central hub section 110 (110' in the stator). Except as will be noted, the stator 104 and rotor 102 have generally the same configuration and dimensions. In addition, in the preferred embodiment, and as shown for example in FIGS. 2, 4A–4B, and 5A–5C, the lobes and ports of the rotor and stator are configured to provide substantially the same surface area with respect to the mud stream. Thus, as seen in FIG. 5B for a three lobe configuration, both the lobes and ports each extend along an arc of generally 60° from the central hub section 110. It is noted that while the stator 104 will be positioned to preferably provide no clearance between its outer circumference and the drill collar 30, the rotor 102 will provide a small clearance, preferably about 1/16".

Although the rotor 102 and stator 104 may each have any number of lobes and ports, three lobes 106, 106' for each of rotor 102 and stator 104 presents an effective configuration.

It is further noted that the lobes 106 of the rotor 102 are cross-sectionally tapered in the direction of fluid flow. This arrangement is depicted in FIG. 2 wherein rotor lobe 106 is seen having a top, or upstream, surface 107, bottom, or downstream, surface 109 and side surfaces 111. The taper of side surfaces 111 will preferably be between 80° and 30° as measured from the axis of the MUD tool 30.

As FIG. 2 illustrates, each lobe 106' of the stator 104 provides a generally square or rectangular cross-section as viewed from its radial end. Lobe 106' of the stator 104 features a top, or upstream, surface 113, a bottom, or downstream surface 115, and two side surfaces 117. It is preferred that, unlike the lobes 106 of the rotor 102, the side surfaces 117 of the stator 104 are generally parallel to each other. In an exemplary embodiment, the outer diameter of the and rotor is 2¾" with the diameter of the hubs 110, 110' having a diameter of 1½. An optimal taper for lobes 106 is 10°.

Preferably, the top surfaces 107 of the rotor lobe 106 will be of a slightly smaller dimension than the width of the downstream surfaces 115 of the stator lobes 106' which are located upstream from the rotor 102. Each stator lobe 106' will then slightly overlap the top surface 107 of adjacent rotor lobes 106 when the rotor lobes 106 are positioned directly beneath a stator lobe 106' (See FIG. 2).

An elongated plunger 112 extends axially downwardly through hub section 110 of the rotor 102. The plunger 112 is preferably affixed to the rotor 102 for rotational movement therewith. The upper portion of the plunger 112 preferably extends through an aperture (not shown) in the central hub 110' of the stator 104. However, the plunger 112 should not be affixed to the stator 104 and should instead be free to slide axially through the aperture as well as to rotate within it.

Referring once more to FIGS. 2, 3A and 3B, located axially below the rotor 102 is a linear actuator 120 which preferably comprises a solenoid assembly of standard design in which an electrical coil (not shown) is energized or deenergized to selectively create a surrounding magnetic field which moves an armature, or plunger, with respect to the coil. The plunger 112 extends into and through the actuator 120 and will be moved axially upward when the actuator is energized. When the solenoid is deenergized, the plunger 112 will return to its initial downward position. The actuator 120 is centrally affixed within the mud tool 30 by a number of radially extending support members 122. The linear actuator 120 is preferably energized by a transmitter 126, which is operably associated with the linear actuator 120 by means of wires 124. The transmitter 126 either incorporates or relays information from the encoder 38. The transmitter 126 is likewise operably associated with a data source 128 by wires 130. The data source 128 may include sensors 39, 41.

The rotor 102 is positioned within the interior of the MWD tool 30 downstream from the stator 104, with a variable spacing between the rotor 102 and stator 104. The variable spacing of these components may be more readily understood with reference to and comparison between FIGS. 3A and 3B.

The pulser 100 is capable of placement into two positions, each of which is associated with an open or closed condition for the pulser 100. In the first position, illustrated in FIG. 3A and 4A, the pulser 100 is in an open condition such that fluid may flow through and past the pulser 100. In this first position, a gap X exists between the rotor 102 and stator 104. This gap X typically measures ⅛" or larger. The exact distances for gap X may vary in accordance with the sizes and thicknesses of the rotor 102 and stator 104, as well as the number of lobes present on the rotor 102 and stator 104.

Figure 3A:
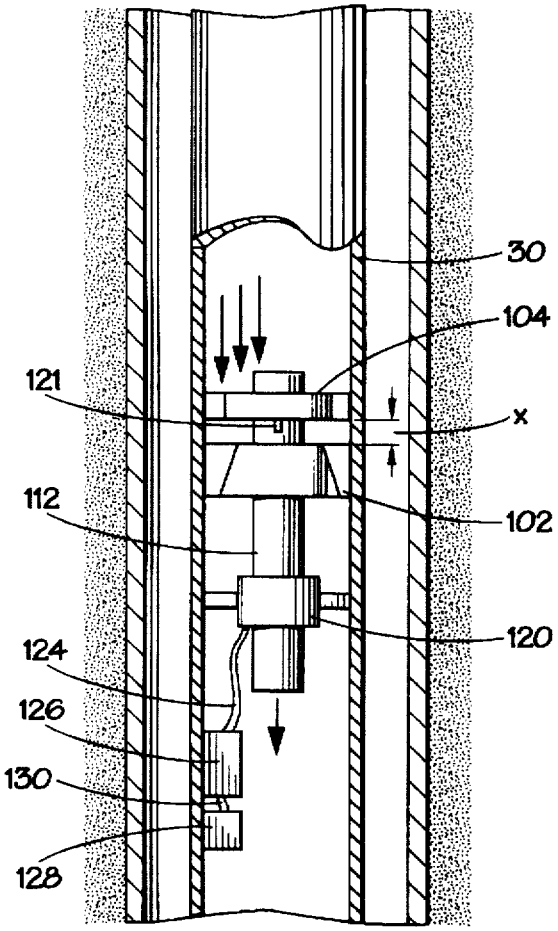
FIG. 3A is a side view, partially in section, of an exemplary pulser assembly with the ports of the stator in an open position.
Figure 3B:
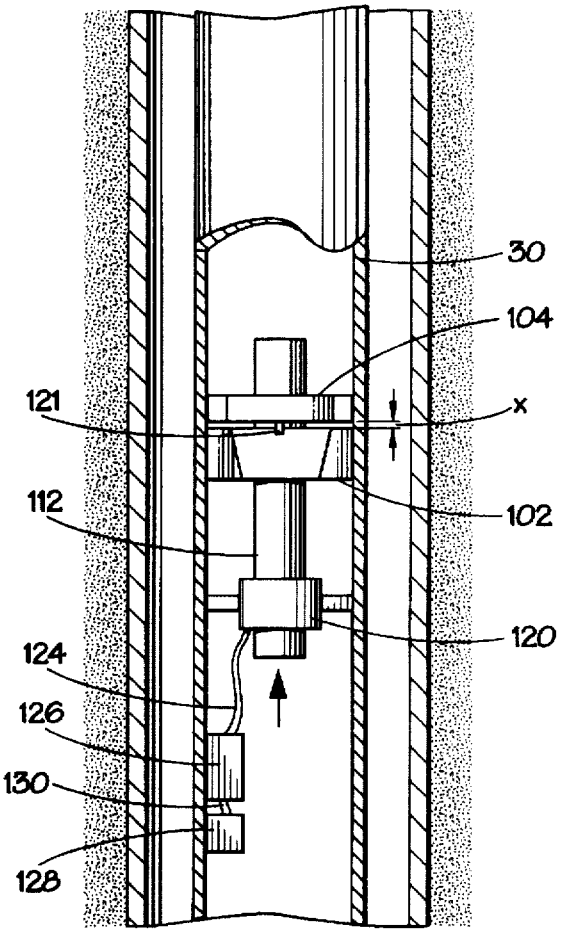
FIG. 3B is a side view, partially in section, of an exemplary pulser assembly with the ports of the stator in a closed position.
Figure 4A:
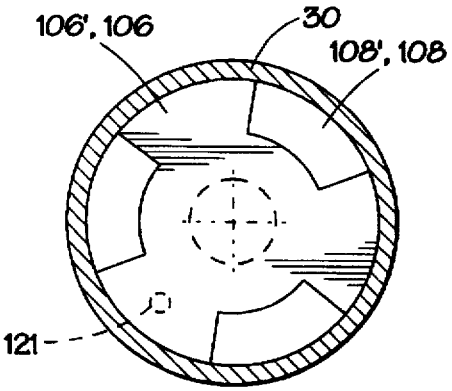
FIGS. 4A and 4B are plan sectional views of the portions of the pulser of FIGS. 3A and 3B illustrating open and closed positions, respectively, for the pulser.
Figure 4B:
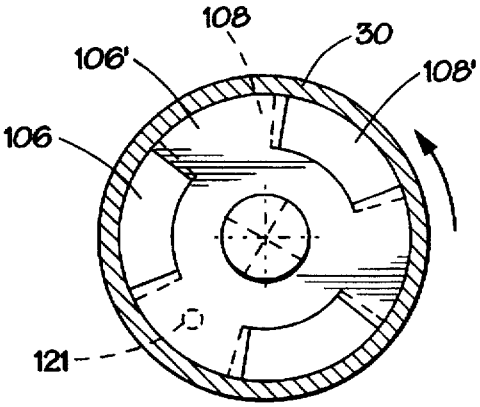

The second position for the pulser 100 is illustrated in FIGS. 3B and 4B. In this position, the plunger 112 and rotor 102 have rotated slightly with respect to the stator 104 (as indicated by the arrow of FIG. 4B) such that the lobes 106 of the rotor 102 are blocking the ports 108' of the stator 104 and the lobes 106' of the stator 104 block the ports 108 of the rotor 102. The pulser 100 is now in a closed condition against flow of fluid through or past the pulser 100. It is noted that in the second position of FIG. 2, the gap between the rotor 102 and stator 104 has been reduced from X to X'. The gap X' generally measures less than ⅛. If the pulser 100 is returned to its first position, the plunger 112 and rotor 102 will again rotate slightly so as to place the pulser 100 once more into an open position.

It has been observed that, by reducing the spacing between the rotor and stator in a situation where fluid is being flowed past, the rotor 102 will tend to rotate without application of an angular force to the rotor 102 or to the plunger 112 to a "stable closed" position, causing the ports 108 and 108' of the rotor 102 and stator 104, respectively, to become blocked against fluid flow. Conversely, by increasing the spacing from X' to X, the rotor 102 will tend to rotate slightly again to a "stable open" position, causing the ports 108 and 108' of the rotor 102 and stator 104, respectively to be opened and to permit fluid flow therethrough. The components of the pulser 100 tend to assume either the stable open or stable closed positions and not any intermediate position. The pulser 100, therefore, will either be fully open or fully closed. Therefore, by operation of the linear actuator 120 to move the plunger 112 upward and downward, the pulser 100 may be selectively opened and closed. It is believed that the tapering of the rotor lobes described previously plays a significant role in causing the rotor 102 to behave in this manner. Due to the tapering, a portion of the side surface 111 is presented toward the fluid flowing within the tool 30. It is believed that this portion of the side surface 111 provides a force bearing surface (See FIGS. 5A–5C) against which fluid flowing through the stator will impact and, when the rotor 102 is at a greater distance from the stator 104, this impact will influence the rotor 102 to move to a position in which its lobes 106 are located directly beneath those of the stator 104. When the distance between the rotor 102 and stator 104 is reduced, it is believed that the resulting pressure in the vicinity of the sides of the rotor lobes 106 will cause rotor 102 to rotate slightly and assume a position wherein the lobes 106 are blocking ports 108' of the stator 104.

To further ensure that the rotor 102 will not inadvertently rotate to the stable open position after the spacing between it and the stator 104 is reduced to X', it is preferred that a S pin or projection 121 be affixed to the lower side of at least one lobe 106' of the stator 104. The pin 121 should project downward from the stator 104 a distance which is greater than X' but less than X.

In operation, the drilling mud flows into the pulser assembly 100 as shown by the arrows 73. By operation of the linear actuator 120, the ports 108' of the stator 104 are alternately opened and closed to establish an acoustic pulse or hydraulic signal within the fluid or mud column.

The linear actuator 120 causes the pulser 100 to open and close with a snap action. In other words, the pulser 100 will open and close so as to produce stepped, discrete pulses within the fluid flow. As a result, the signal created by the pulser 100 will consist of discrete pulses induced by axial reciprocation of the rotor 102 by the linear actuator 120. It is pointed out, however, that energy from the fluid flow is still used to partially power the pulser 100. In addition, transmission of pulses may be halted, if desired, without having to interrupt or change flow characteristics.

As will be understood by one skilled in the art, downhole information can be encoded into the pulser signal in many ways. It is preferred that the information be encoded using the NRZ telemetry technique.

One skilled in the art will understand that it would be possible to construct a pulser assembly, for example, wherein the stator, rather than the rotor, is moved axially and thus induce rotary movement of the rotor. Also, one might use other methods for axially moving or reciprocating the components in the manner described. While a preferred embodiment of the invention has been shown and described, modifications thereof can be made by one skilled in the art without departing from the spirit of the invention.

What is claimed is:

1. A snap action pressure pulse generator for creating an acoustic pulse within a fluid stream comprising:

(a) a housing defining a flowbore therethrough;

(b) a stator fixedly positioned within the housing, said stator having a central hub with a lobe radially extending therefrom and at least one port permitting a fluid stream to pass therethrough;

(c) a rotor positioned within the housing downstream from said stator, said rotor having a central hub with a lobe radially extending therefrom, said rotor being rotatable within the housing;

(d) a linear actuator operably associated with said rotor for effecting axial movement of the rotor with respect to the stator, said axial movement resulting in rotational movement of the rotor to selectively close the opening in said stator.

2. The pressure pulse generator of claim 1 wherein the rotor is axially moveable between a first position which results in a condition wherein the lobe of the rotor substantially closes the port of the stator against flow of the fluid stream therethrough and a second position which results in a condition wherein the lobe of the rotor does not substantially close the port of the stator against flow of the fluid stream therethrough.

3. The pressure pulse generator of claim 2 wherein the lobe of the rotor is cross-sectionally tapered in an upstream direction.

4. The pressure pulse generator of claim 3 wherein the linear actuator comprises a solenoid assembly.

5. The pressure pulse generator of claim 3 wherein at least one lobe of the stator presents a downward projection to prevent rotation of the rotor to a position where it does not substantially close the port of the stator against fluid flow therethrough when the rotor is moved to the first position.

6. A snap action pressure pulse generator for creating an acoustic pulse within a fluid stream comprising:

(a) a housing defining a flowbore therethrough;

(b) a stator fixedly positioned within the housing, said stator having a central hub with a lobe radially extending therefrom and at least one port permitting a fluid stream to pass therethrough; and (c) a rotor positioned within the housing downstream from said stator, said rotor having a central hub with a lobe radially extending therefrom, said rotor being rotatable within the housing, the rotor further being axially moveable between a first position which results in a condition wherein the lobe of the rotor substantially closes the port of the stator against flow of a fluid stream therethrough and a second position which results in a condition wherein the lobe of the rotor does not substantially close the port of the stator against flow of a fluid stream therethrough.

7. The assembly of claim 6 further comprising an actuator operably associated with said rotor for effecting axial movement of the rotor with respect to the stator, said axial movement resulting in rotational movement of the rotor to selectively close the opening in said stator.

8. The assembly of claim 7 wherein the actuator is operably associated with the rotor by an elongated plunger affixed to the rotor and extending into the actuator, the plunger being selectively axially moveable by energization of the actuator.

9. A pressure pulse generator for creating an acoustic pulse within a fluid stream comprising:

(a) a housing defining a flowbore therethrough;

(b) a stator fixedly positioned within the housing, said stator having a central hub with a lobe radially extending therefrom and at least one port permitting a fluid stream to pass therethrough;

(c) a rotor positioned within the housing downstream from said stator, said rotor having a central hub with a lobe radially extending therefrom, said rotor being rotatable within the housing, the rotor further being axially moveable between a first position which results in a condition wherein the lobe of the rotor substantially closes the port of the stator against fluid flow therethrough and a second position which results in a condition wherein the lobe of the rotor does not substantially close the port of the stator against fluid flow therethrough;

(d) an actuator within said housing being operable to induce axial movement of a plunger inserted within the actuator; and (e) an elongated plunger being affixed to the rotor and extends into the actuator, the plunger being selectively axially moveable by energization of the actuator.

10. A snap action method of operating a pressure pulse assembly to produce a snap action pulse within a fluid comprising the steps of:

(a) providing a pulser assembly within a flowbore which is adapted to contain fluid, the pulser assembly comprising:

a housing defining a flowbore therethrough;

a stator fixedly positioned within the housing, said stator having a central hub with a lobe radially extending therefrom and at least one port permitting fluid to pass therethrough; and a rotor positioned within the housing downstream from said stator, said rotor having a central hub with a lobe radially extending therefrom, said rotor being rotatable within the housing;

the rotor and stator further being positioned in a spaced relation from each other, the spaced relation being variable between a first position which results in a condition wherein the lobe of the rotor substantially closes the port of the stator against fluid flow therethrough and a second position which results in a condition wherein the lobe of the rotor does not substantially close the port of the stator against fluid flow therethrough;

(b) flowing fluid through the flowbore past the pulser assembly; and (c) varying the axial distance of the rotor from the stator between the first and second positions to selectively produce a pressure pulse within the fluid.

11. The method of claim 10 wherein the axial distance of the rotor from the stator is varied by axially moving the rotor with respect to the stator.

* * * * *